US006821216B1

(12) United States Patent
Van Asselt

(10) Patent No.: US 6,821,216 B1
(45) Date of Patent: Nov. 23, 2004

(54) BALL GAME APPARATUS

(76) Inventor: Jan Abraham Van Asselt, The Spinney, Mynthurst, Leigh, Reigate, Surrey RH2 8RJ (GB)

( * ) Notice: Subject to any disclaimer, the term of this patent is extended or adjusted under 35 U.S.C. 154(b) by 0 days.

(21) Appl. No.: 09/582,556

(22) PCT Filed: Jan. 4, 1999

(86) PCT No.: PCT/GB99/00001

§ 371 (c)(1),
(2), (4) Date: Aug. 22, 2000

(87) PCT Pub. No.: WO99/34884

PCT Pub. Date: Jul. 15, 1999

(30) Foreign Application Priority Data

Jan. 3, 1998 (GB) ..... 9800015

(51) Int. Cl.[7] ..... A63B 69/00
(52) U.S. Cl. ..... 473/422; 473/426; 473/428
(58) Field of Search ..... 473/422–431, 473/138–149, FOR 103, 108, 109, 213; 273/331–333, 334, 335

(56) References Cited

U.S. PATENT DOCUMENTS 650,008 A * 5/1900 Hamel ..... 273/359
766,112 A * 7/1904 Murray ..... 273/369
1,281,687 A * 10/1918 Stelling ..... 273/406
2,494,210 A * 1/1950 Smith ..... 273/369
3,086,775 A 4/1963 Albert
3,114,549 A 12/1963 Hooker
3,471,153 A * 10/1969 Baumler ..... 273/370
3,475,026 A * 10/1969 Cooper ..... 473/430
3,630,521 A 12/1971 Lingbeek et al.
4,138,107 A 2/1979 Janis
4,944,513 A * 7/1990 Zentner ..... 473/428
5,072,937 A * 12/1991 Zarate ..... 473/426
5,460,364 A * 10/1995 Ring ..... 473/429
5,713,805 A * 2/1998 Scher et al. ..... 473/426
6,042,491 A * 3/2000 Dixon, Jr. ..... 473/423
6,290,618 B1 * 9/2001 Ring ..... 473/429

FOREIGN PATENT DOCUMENTS

GB 201645 * 8/1923

* cited by examiner

*Primary Examiner*—Mitra Aryanpour
(74) *Attorney, Agent, or Firm*—Blank Rome LLP

(57) ABSTRACT

An apparatus for use in playing and practicing ball games is disclosed, the apparatus including a ball suspended by a substantially inelastic upstanding line from an upper, generally horizontal or inclined elongated guideway and connected by the same or a second substantially inelastic upstanding line to a lower, generally horizontal or inclined elongated guideway. The lower guideway may be at ground level and the height of the ball above the ground may be adjustable.

37 Claims, 2 Drawing Sheets

BALL GAME APPARATUS

This invention relates to apparatus for use in playing and practising ball games. More especially, but not exclusively, the invention relates to apparatus for improving the skills of participants in ball games.

The term "ball games" as used herein embraces games such as tennis, baseball, golf, badminton and the like, in which a projectile such as a ball, shuttlecock or the like is propelled by a racquet, stick, club or the like.

In the field of competitive sport it is a well known adage that practice makes perfect. Thus, for example, tennis players spend many hours improving inter alia forward and backhand strokes on tennis courts.

In the field of tennis, there are several inanimate tennis trainers available, these including inter alia, a ball attached by an elasticated strand, string or rope to some form of central support. Such trainers are unsatisfactory because the ball approaches the player at an unrealistic angle and speed. Furthermore, missing the ball results in the elasticated strand, string or rope becoming inconveniently entangled around the support.

Children also enjoy ball games, but unless they are coached, they have even less opportunity of improving their skills. Furthermore, few children have sufficient space and freedom from houses and cars to play ball games unrestrictedly.

Disabled persons, especially those confined to wheelchairs and who do not have the mobility of an able bodied person, cannot play conventional ball games and find obvious difficulties with currently available tennis trainers and the like.

Similar problems arise with other ball games.

U.S. Pat. No. 4,138,107 relates to a ball game practice device which comprises a ball connected to an elastic tether, the tether connected at either end to a carriage member which runs along a rigid rail. It is the elastic nature of the tether which after full stretch, returns the ball to the player.

U.S. Pat. No. 3,630,521 relates to a baseball batting practice device. Once again, a ball is connected to an elastic cord which is slidably linked to an upper and lower support wire. In both these disclosures, the elastic nature of the tether to the ball allows somewhat uncontrolled lateral movement of the ball once struck by the player.

Therefore, there is a need to provide apparatus for simulating ball games which can be adapted for one or more players, which is suitable for adults, children and disabled persons, which is economical to produce and which can be used in a controlled manner in relatively small areas without concern over surrounding buildings and cars.

The present invention sets out to provide such apparatus.

Accordingly, in one aspect the invention provides apparatus for use in playing and practising ball games which comprises upper and lower guideways, substantially inelastic reciprocating means connected to and freely movably along said upper and lower guideways, and a ball connected to said reciprocating means.

The term "substantially inelastic" as used herein applies to materials which have a very limited ability to stretch and change length when struck.

The upper guideway may be inclined. Also, the maximum height of the upper guideway above the lower guideway may be greater than the length of the reciprocating means. In this arrangement, when the reciprocating means is positioned at, or towards, one end of the guideways, a player may strike the ball and propel the reciprocating means forwardly along the guideways. However, when the length of the reciprocating means becomes limiting in relation to the distance between the upper and lower guideways, the reciprocating means decelerates, stops and is deflected back along the guideways towards the player.

Importantly, the reciprocating means are made from a substantially inelastic material. Not only does this ensure that the ball maintains a controlled horizontal trajectory regardless of the angle at which the player hits the ball, but the inelasticity of the reciprocating means ensures its length becomes limiting in relation to the distance between the upper and lower guideways thereby deflecting the ball back to the player.

The force required to strike the ball on the reciprocating means may be regulated by altering the position of the lower guideway relative to the upper guideway. Thus for example, moving one end of the lower guideway nearer to a point directly below an end of the upper guideway increases the speed and force of the ball approaching a player standing at a fixed point.

It is preferred that the ends of the lower guideway are adjustably engaged with the ground so that the force and speed of the ball on the reciprocating means may be varied according to the competence of the player.

In an alternative arrangement, the upper and lower guideways are substantially parallel. This arrangement is of especial interest to children and disabled persons where there is a common requirement for the ball to stay within defined limits. Wheelchair-bound persons may thus develop ball game skills using this invention.

Typically, the ends of the upper, and optionally the lower guideway, are attached to a stable support. In particular, the stable support is a wall or pole.

The upper and lower guideways may lie in a plane which is generally normal to the ground or in a plane which is inclined thereto.

The reciprocating means may comprise a substantially inelastic upstanding line connected to the upper and lower guideways.

The invention also contemplates an embodiment wherein the reciprocating means comprises more than one substantially inelastic upstanding line, for example, wherein the reciprocating means comprises one substantially inelastic upstanding line connected to the upper guideway and another associated substantially inelastic upstanding line connected to the lower guideway.

The reciprocating means may be connected to the upper and lower guideways through a slide which may comprise a hinged clip, ring, rope slide or adjustable loop.

In one embodiment the upper and/or lower guideways and/or the reciprocating means are made of a low friction material such as plastics covered cord or wire. The upper and lower guideways and the reciprocating means may be made of the same material.

The invention also contemplates an embodiment where the upper and/or lower guideways are made of a substantially rigid material. By substantially rigid it is meant relatively inflexible. Therefore, one or both guideways may take the form of a plastics track which is capable of receiving a runner to which the reciprocating means is connected.

The ball may be connected at any point along the reciprocating means. This affords the possibility of the apparatus being used as apparatus for any ball game. For example, the ball may be attached towards the middle point of the reciprocating means to simulate apparatus for playing tennis or baseball, or alternatively, the ball may be attached near the lower end of the reciprocating means to simulate apparatus for playing golf.

Accordingly, the ball may be chosen from inter alia a tennis ball, a baseball, a rounders ball, a shuttlecock, a cricket ball, a hockey ball, or a golf ball.

In another aspect, the invention provides apparatus for use in playing and practising ball games, comprising a ball suspended by a substantially inelastic upstanding line from an upper, generally horizontal or inclined elongate guideway and connected by the same or a second substantially inelastic upstanding line to a lower, generally horizontal or inclined elongate guideway.

The lower elongate guideway may be at ground level. The height of the ball above ground level may be adjustable.

The upper and lower guideways may lie in a plane which is generally normal to the ground or in a plane which is inclined thereto. One or each guideway may take the form of a string, rope or the like stretched between two spaced supports. The line may be coated with or formed from a material having relatively low friction properties, for example a plastics material.

The substantially inelastic upstanding line(s) may be connected to the upper and/or lower guideway by a slide in the form of, for example, a loop or ring.

The invention will now be described by way of example only with reference to the following diagrammatic drawings, in which.

Figure 1:
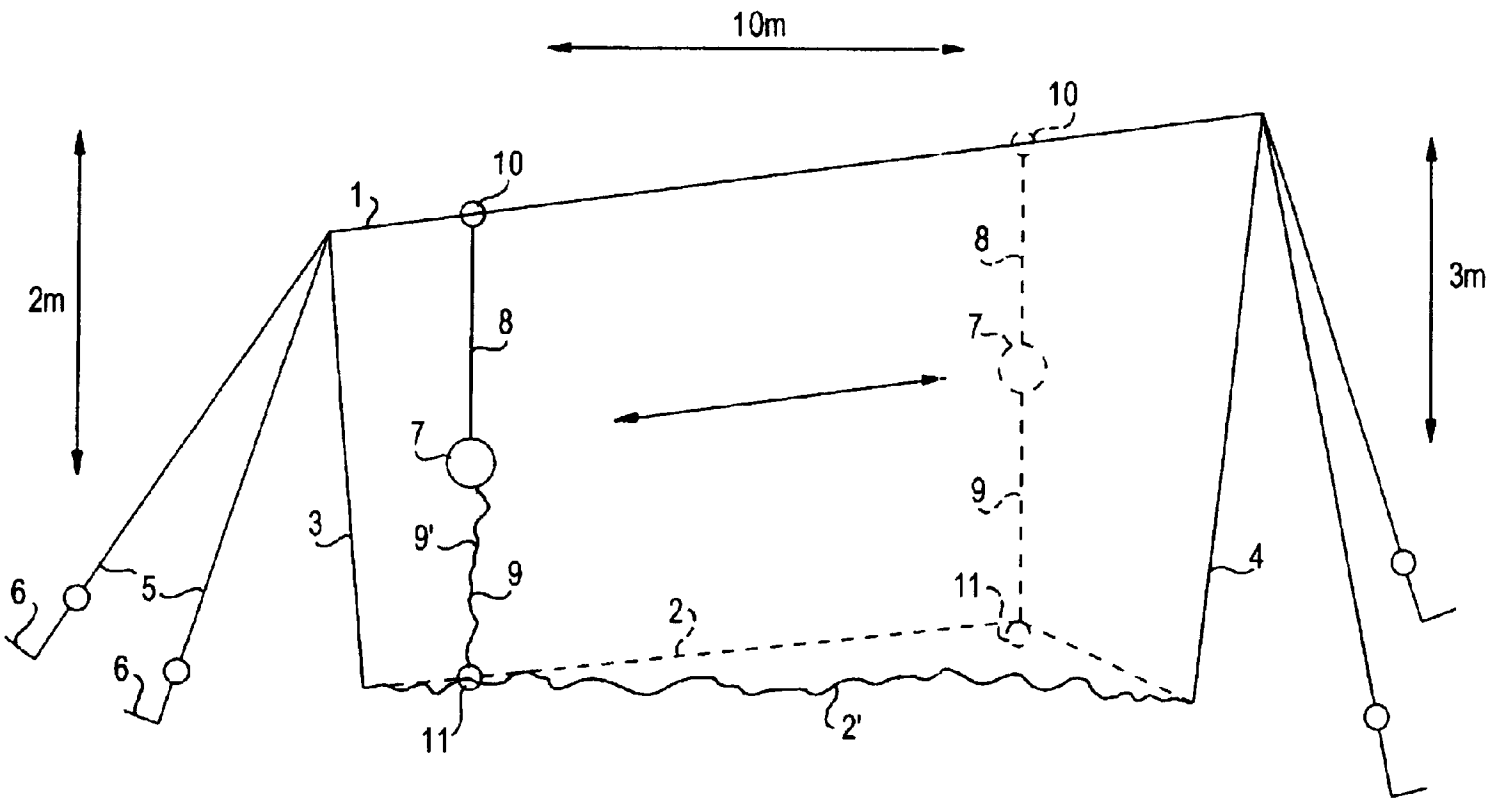
FIG. 1 is a side view in perspective of apparatus in accordance with the invention.

The apparatus shown in FIG. 1 takes the form of a tennis training aid, especially for one player. The apparatus comprises upper and lower guideways 1, 2 respectively, of plastics coated cord which are attached at their ends to two supports 3, 4 spaced approximately 10 meters apart. Typically, the heights of the supports above ground level are respectively two meters and three meters. Thus the height of the upper guideway 1 above ground level is greater at its point of connection to support 4 than at its point of connection to support 3. The supports 3, 4 are held in position by inclined guide ropes 5 attached to ground engaging pegs 6. The lower guideway 2 is fixed at ground level and the upper guideway 1 is inclined upwardly from the support 3. Two positions of the lower guideway are shown in FIG. 1, these being shown in full line and broken line. A ball 7 is suspended by an inelastic line 8 to the upper guideway 1 and by an inelastic line 9 to the lower guideway 2. The line 8 is supported from the upper guideway 1 by a loop or ring 10 and the line 9 is connected to the lower guideway 2 by a loop or ring 11. The lines 8, 9 may be secured to the ball by stitching, stapling or any other means. In an alternative arrangement, a single inelastic line is used, this extending through or around the periphery of the ball.

When the training aid is in use, a player stands near the lower guideway 2 at its point of connection to support 3 and strikes the ball 7 with a racquet or the like using either forehand or backhand strokes. The starting position of the ball 7 and lines 8, 9 (and the guideway 2) are shown in fill line to the left hand side of FIG. 1. In that starting position, the lower guideway 2 includes slack 2' and line 9 includes slack 9', as indicated by the wavy full lines in FIG. 1. The force of the strike sends the lines 8, 9 and the ball 7 along the upper and lower guideways 1, 2 towards the limiting position shown in broken line. Once the distance between the ends of the lines 8, 9 (the lower guideway 2 now being in its raised position shown in broken line) becomes taut and limiting in relation to the distance between the upper and lower guideways, the lines 8, 9 slow down, stop and are deflected back along the upper and lower guideways to return to the player who can then strike the ball again.

Figure 2:
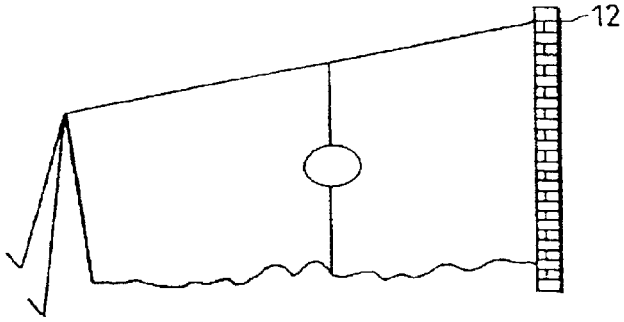
FIGS. 2 and 3 illustrate different ways of supporting the apparatus of FIG. 1.
Figure 3:
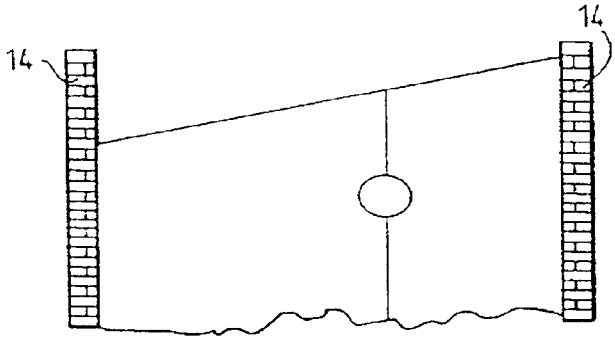

FIGS. 2 and 3 illustrate different methods of supporting the apparatus e.g. attachment at one end to a wall 12 as in FIG. 2 and attached between two walls 14 as shown in FIG. 3.

Figure 4:
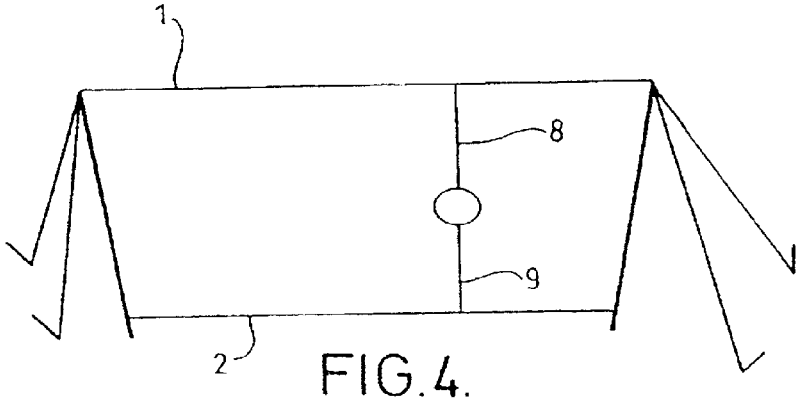
FIG. 4 is a side view in perspective of alternative apparatus in accordance with the invention.

The apparatus shown in FIG. 4 illustrates an alternative embodiment in accordance with the invention and is especially designed for two players. In this embodiment, the upper and lower guideways 1, 2 are generally parallel so that a ball can be played at either end of the apparatus to send the lines 8, 9 along the upper and lower guideways 1, 2 to the other player.

It will be appreciated that the foregoing is merely exemplary of embodiments of the invention and that modifications can readily be made without departing from the scope of the invention.

Thus, the length of the upper and lower guideways may be greater or less than 10 meters. Also, the single supports 3, 4 may be replaced by sideways spaced supports to provide greater access to the ball by a player or players. The upper and/or lower guideway 1 or 2 may be produced from a relatively rigid material and may comprise a length of, for example, plastics formed with a track which receives a runner to which the line 8 or 9 is attached.

As mentioned previously, the "ball" 7 may comprise a tennis ball, base ball, golf ball or like projectile such as a shuttlecock. The height of the ball 7 above ground level is therefore readily adjustable to simulate playing conditions for all of such games.

What is claimed is:

1. Apparatus for use in playing and practicing ball games comprising a generally inclined upper guideway, a generally inclined or horizontal lower guideway, substantially inelastic reciprocating means connected to and freely moveable along said upper and lower guideways, a ball connected to said reciprocating means, a first upstanding stable support connected to the first end of the upper and lower guideways, and a second, spaced apart, upstanding stable support connected to the second end of the upper and lower guideways, wherein the lower guideway between the first and second upstanding stable supports is slack when the ball is at rest.

2. Apparatus according to claim 1 wherein the maximum height of the inclined upper guideway above ground level is greater than the length of the reciprocating means.

3. Apparatus according to claim 1 wherein the upper and lower guideways are substantially parallel.

4. Apparatus according to claim 1 wherein the upper and lower guideways lie in a plane which is generally normal to the ground.

5. Apparatus according to claim 1 wherein the upper and lower guideways lie in a plane which is inclined to the ground.

6. Apparatus according to claim 1 wherein the first upstanding stable support is one of a wall and a pole and wherein the second upstanding stable support is one of a wall and a pole.

7. Apparatus according to claim 1 wherein the one of the stable supports is adjustably positionable.

8. Apparatus according to claim 1 wherein the reciprocating means comprises one or more upstanding lines connected to the upper and lower guideways.

9. Apparatus according to claim 8, wherein the portion of the one or more upstanding lines between the ball and the lower guideway is slack when the ball is at rest.

10. Apparatus according to claim 8 wherein the reciprocating means comprises one upstanding line connected to the upper guideway and another associated upstanding line connected to the lower guideway.

11. Apparatus according to claim 1 wherein the reciprocating means is connected to the upper and lower guideways through a slide.

12. Apparatus according to claim 1 wherein the slide comprises a hinged clip, ring, rope slide or adjustable loop.

13. Apparatus according to claim 1 wherein the upper and lower guideways or the reciprocating means are made of a low friction material.

14. Apparatus according to claim 1 wherein the upper and lower guideways or the reciprocating means are made of plastics covered cord or wire.

15. Apparatus according to claim 1 wherein the upper and lower guideways and the reciprocating means are made from the same material.

16. Apparatus according to claim 1 wherein the upper and lower guideways are made of a substantially rigid material.

17. Apparatus according to claim 1 wherein the upper or lower guideway comprises a plastics track which is capable of receiving a runner to which the reciprocating means is connected.

18. Apparatus according to claim 1 wherein the ball can be connected at any point along the reciprocating means.

19. Apparatus according to claim 1 wherein the ball is one of a tennis ball, a baseball, a rounders ball, a cricket ball, a hockey ball, and a golf ball.

20. Apparatus according to claim 1 further comprising a guide rope and a peg, wherein one end of the guide rope is attached to the top of one of the first and second upstanding stable supports and the other end is attached to the peg and wherein the peg is connected to the ground.

21. Apparatus for use in playing and practicing ball games comprising a generally inclined upper guideway with first and second ends, a generally inclined or horizontal lower guideway with first and second ends, substantially inelastic reciprocating means connected to and freely moveable along said upper and lower guideways, a ball connected to said reciprocating means, a pole connected to the first ends of the upper and lower guideways, and a pole or a wall connected to the second ends of the upper and lower guideways, wherein the lower guideway is slack when the ball is at rest.

22. Apparatus according to claim 21, wherein the reciprocating means comprises a first upstanding line connected to the upper guideway and the ball and a second upstanding line connected to the ball and the lower guideway, wherein the lower upstanding line is slack when the ball is at rest.

23. Apparatus for use in playing and practicing ball games comprising a slanted upper guideway with first and second ends, a generally horizontal lower guideway with first and second ends, substantially inelastic reciprocating means connected to and freely moveable along said upper and lower guideways, a ball connected to said reciprocating means, a pole connected to the first ends of the upper and lower guideways, and a pole or a wall connected to the second ends of the upper and lower guideways.

24. Apparatus according to claim 23 wherein the reciprocating means comprises a first upstanding line connected to the upper guideway and the ball and a second upstanding line connected to the ball and the lower guideway, wherein the lower upstanding line is slack when the ball is at rest.

25. Apparatus according to claim 23 wherein the maximum height of the slanted upper guideway above ground level is greater than the length of the reciprocating means.

26. Apparatus according to claim 23 wherein the upper and lower guideways lie in a plane which is generally normal to the ground.

27. Apparatus according to claim 23 wherein the upper and lower guideways lie in a plane which is inclined to the ground.

28. Apparatus according to claim 23 wherein one of the poles is adjustably positionable.

29. Apparatus according to claim 23 wherein the reciprocating means comprises a first upstanding line portion connected to the ball and to the upper guideway and a second upstanding line portion connected to the ball and to the lower guideway.

30. Apparatus according to claim 23 wherein the reciprocating means is connected to the upper and lower guideways by a slide.

31. Apparatus according to claim 30 wherein the slide comprises a hinged clip, ring, rope slide or adjustable loop.

32. Apparatus according to claim 23 wherein the upper and lower guideways or the reciprocating means are made of a low friction material.

33. Apparatus according to claim 23 wherein the upper and lower guideways or the reciprocating means are made of plastics covered cord or wire.

34. Apparatus according to claim 23 wherein the upper and lower guideways and the reciprocating means are made from the same material.

35. Apparatus according to claim 23 wherein the upper and lower guideways are made of a substantially rigid material.

36. Apparatus according to claim 35 wherein the upper or lower guideway comprises a plastics track which is capable of receiving a runner to which the reciprocating means is connected.

37. Apparatus according to claim 36 wherein the ball can be connected at any point along the reciprocating means.

* * * * *